US006165056A

United States Patent [19]

Hayashi et al.

[11] Patent Number: 6,165,056

[45] Date of Patent: Dec. 26, 2000

[54] POLISHING MACHINE FOR FLATTENING SUBSTRATE SURFACE

[75] Inventors: Yoshihiro Hayashi; Takahiro Onodera, both of Tokyo; Kazuo Kobayashi, Kanagawa, all of Japan

[73] Assignees: NEC Corporation; Nikon Corporation, both of Tokyo, Japan

[21] Appl. No.: 09/203,392

[22] Filed: Dec. 2, 1998

[30] Foreign Application Priority Data

Dec. 2, 1997 [JP] Japan ..... 9-332019

[51] Int. Cl.[7] ..... B24B 7/00

[52] U.S. Cl. ..... 451/281; 451/550; 451/283; 451/363; 451/446; 451/290; 451/332

[58] Field of Search ..... 451/550, 280, 451/283, 363, 446, 290, 332, 495, 504

[56] References Cited

U.S. PATENT DOCUMENTS

| | | | |
|---|---|---|---|
| 4,890,420 | 1/1990 | Azimi . | |
| 4,916,868 | 4/1990 | Wittstock | 451/271 |
| 5,216,843 | 6/1993 | Breivogel et al. | 451/271 |
| 5,895,270 | 4/1999 | Hempel, Jr. | 451/287 |
| 5,921,855 | 7/1999 | Osterheld et al. | 451/527 |
| 5,927,264 | 7/1999 | Worley | 125/36 |
| 5,931,722 | 8/1999 | Ohmi et al. | 451/271 |

FOREIGN PATENT DOCUMENTS

| | | |
|---|---|---|
| 5-138529 | 6/1993 | Japan . |
| 5-309559 | 11/1993 | Japan . |
| 7-52033 | 2/1995 | Japan . |
| 8-330261 | 12/1996 | Japan . |
| 9-70751 | 3/1997 | Japan . |
| 9-262743 | 10/1997 | Japan . |
| 9-277160 | 10/1997 | Japan . |
| 10-160420 | 6/1998 | Japan . |
| 2 175 517 | 12/1986 | United Kingdom . |
| 2 219 536 | 12/1989 | United Kingdom . |
| 2 250 947 | 6/1992 | United Kingdom . |
| 2 259 662 | 3/1993 | United Kingdom . |

*Primary Examiner*—David A. Scherbel
*Assistant Examiner*—Shantese McDonald
*Attorney, Agent, or Firm*—Sughrue, Mion, Zinn, Macpeak & Seas, PLLC

[57] ABSTRACT

There is disclosed a polishing machine capable of flattening a wafer surface uniformly. The machine can modify the flatness of the surface during polishing. The machine has an index table and a polishing head 18. The table attracts the wafer to be polished such that the wafer faces upward. The table rotates to the primary polishing station. The polishing head has a pressure application cylinder 21 and a base plate 22. The cylinder is held to a carrier at a given angle. The base plate holds polishing cloth 24 and is mounted to the cylinder so as to be swingable in three dimensions. The cloth touches the wafer surface and rotates at a high speed, thus flattening it. At the second polishing station, polishing cloth attached to another polishing head touches the wafer surface and rotates at a high speed, thus finally polishing the wafer surface.

17 Claims, 13 Drawing Sheets

POLISHING MACHINE FOR FLATTENING SUBSTRATE SURFACE

BACKGROUND OF THE INVENTION

The present invention relates to a polishing machine for flattening surfaces of substrates, especially surfaces of semiconductor wafers on which device patterns are formed.

A polishing machine for flattening a surface layer of a semiconductor wafer on which devices are formed is disclosed in Japanese Unexamined Patent Publication (JP-A) No. 330261/1996. This machine has a turntable, known as a rotatable platen with a polishing cloth or texture adhered on the surface of the platen, and a wafer holder placed above the platen. A semiconductor wafer attracted to the bottom surface of the holder is placed in direct contact with the polishing cloth on the platen. A fluid (pressured air or water) applies pressure against the back side of the wafer. During a polishing process, both platen and holder are rotated to polish the surface layer of the semiconductor wafer. A diameter of the platen is larger than that of the wafer.

In the machine described above, the polishing operation is performed by pressing the semiconductor wafer against the polishing cloth on the platen and rotating the platen and the wafer. During this operation, the wafer is held to the bottom surface of the holder having a nearly same diameter of the wafer. Therefore, it is impossible for an operator to directly view the polishing surface of the semiconductor wafer. And most of polishing slurry supplied onto the polishing cloth on the platen is splashed by the centrifugal force created by the rotation of the platen. In consequence, about 30% amount of the slurry is loss. So it is desired to make effective use of the polishing slurry.

In the coming of the information-oriented era, a ceaseless high demand for high-level electronic devices and appliances is huge. Especially, it is expected that the demand for personal computers will be greatest among various devices and appliances. It is considered that the semiconductor industry will shift to the next-generation wafer fabrication process with this trend. In the future, 300-mm wafers or 400-mm wafers will be introduced. There is an urgent demand for the development of CMP (chemical/mechanical polishing) equipment for flattening the surface layers of devices formed on such larger wafers. Furthermore, it is necessary to develop polishing machines capable of polishing such larger-size bare silicon wafers.

It is considered that in CMP, the film thickness uniformity and surface flatness are the most important characteristics among quality characteristics. Namely, the flatness is the most important characteristic in bare silicon wafers.

Where larger wafers are polished by the conventional polishing method, if polish slurry is supplied by the conventional method (namely, the slurry is supplied on the platen through a pipe which is equipped outside the holder), it is difficult to make uniform the flow rate of polishing slurry across the total surface area of the wafer. Furthermore, even if wafer unduration or waviness is assumed to depend only to the viscoelastic characteristics of the polishing cloth, it is practically difficult to form the unduration of the wafer surface.

In addition, the flatness of the wafer can not be observed or detected by the existing polishing machine during polishing. One method heretofore proposed for detecting the flatness of the wafer during polishing is to measure variations in the load on an electric motor that drives the platen or polishing head (JP-A-138529/1993, JP-A-70751/1997, and JP-A-262743/1997). Another proposed method is to measure the reflection of the ray ejected on the film through the formed holes in the platen of the polishing machine (JP-A-309559/1993 and JP-A-160420/1998). However, none of them have been put into practical use.

Larger wafers are so expensive that is requires to diminish a loss. This requires to detect the flatness of each wafer during the polishing and the flatness must be modified to the desired degree of flatness of the wafer based on the obtained data. For this purpose, it is essential to control the flatness.

In the current polishing operation, the cost of polish slurry mainly dominates a large proportion of the variable cost. Indeed, the cost of slurry reaches 30% of the variable expenses. Furthermore, the efficiency of the slurry is only several percent and a decrease in the cost of slurry will reduce the amount of wastes. This will affect the environment greatly. Where slurry is supplied onto a large surface platen, limitations are imposed on the efficiency of utilization of the slurry. Therefore, there is an urgent demand for reducing the slurry cost.

The final problem arises from the fact that wafers are polished within a cleanroom, which is required to have a high degree of cleanliness. Of course, the cost per a unit area becomes expensive when the cleanroom is kept at high degree of cleanliness. This means that elements or members introduced into the cleanroom must inevitably be made compact.

SUMMARY OF THE INVENTION

It is an object of the present invention to provide a polishing machine which can be made compact, permits a modification of the flatness of a substrate surface with a small polishing pad, and enhances the polishing efficiency by supplying slurry onto the whole surface of the polishing pad.

It is another object of the invention to provide a polishing machine capable of polishing the whole surface of each wafer uniformly, irrespective of the mechanical accuracy of a mechanism for feeding the polishing jig, of the peripheral speed, and of the flatness of the surface of the wafer.

The present invention provides a polishing machine comprising: a table for holding a substrate to be polished in position such that the substrate faces upward; a polishing head having a bottom surface; a polishing surface means formed at least in a part of the bottom surface of the polishing head, which is capable of swinging in three dimensions for polishing the substrate held upon the table; and a polishing pad attached to the polishing surface means.

Other objects and features of the invention will appear in the course of the description thereof, which follows.

DESCRIPTION OF THE PREFERRED EMBODIMENTS

Figure 3:
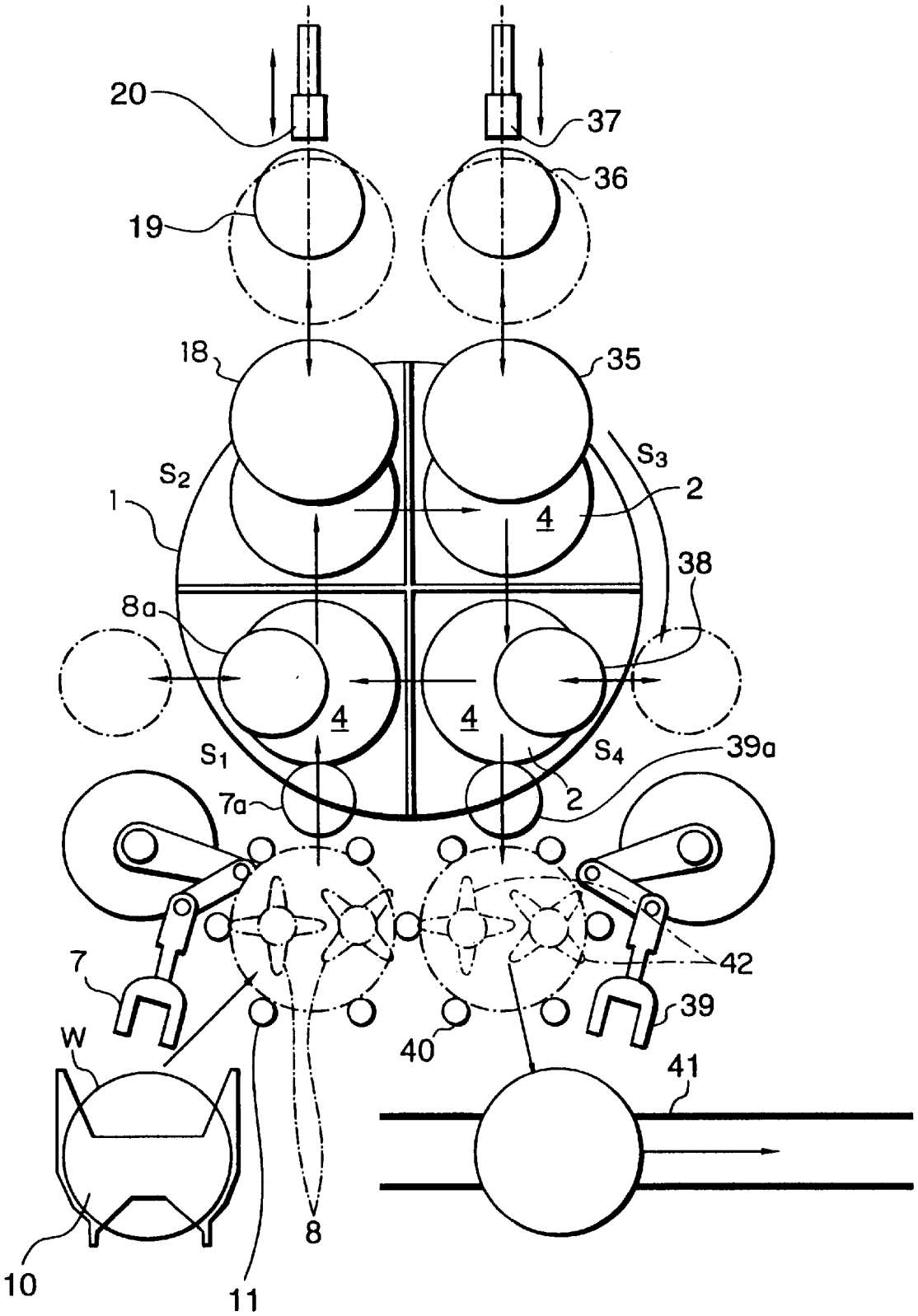
FIG. 3 is a schematic plan view of the polishing machine in accordance with the invention.
Figure 4:
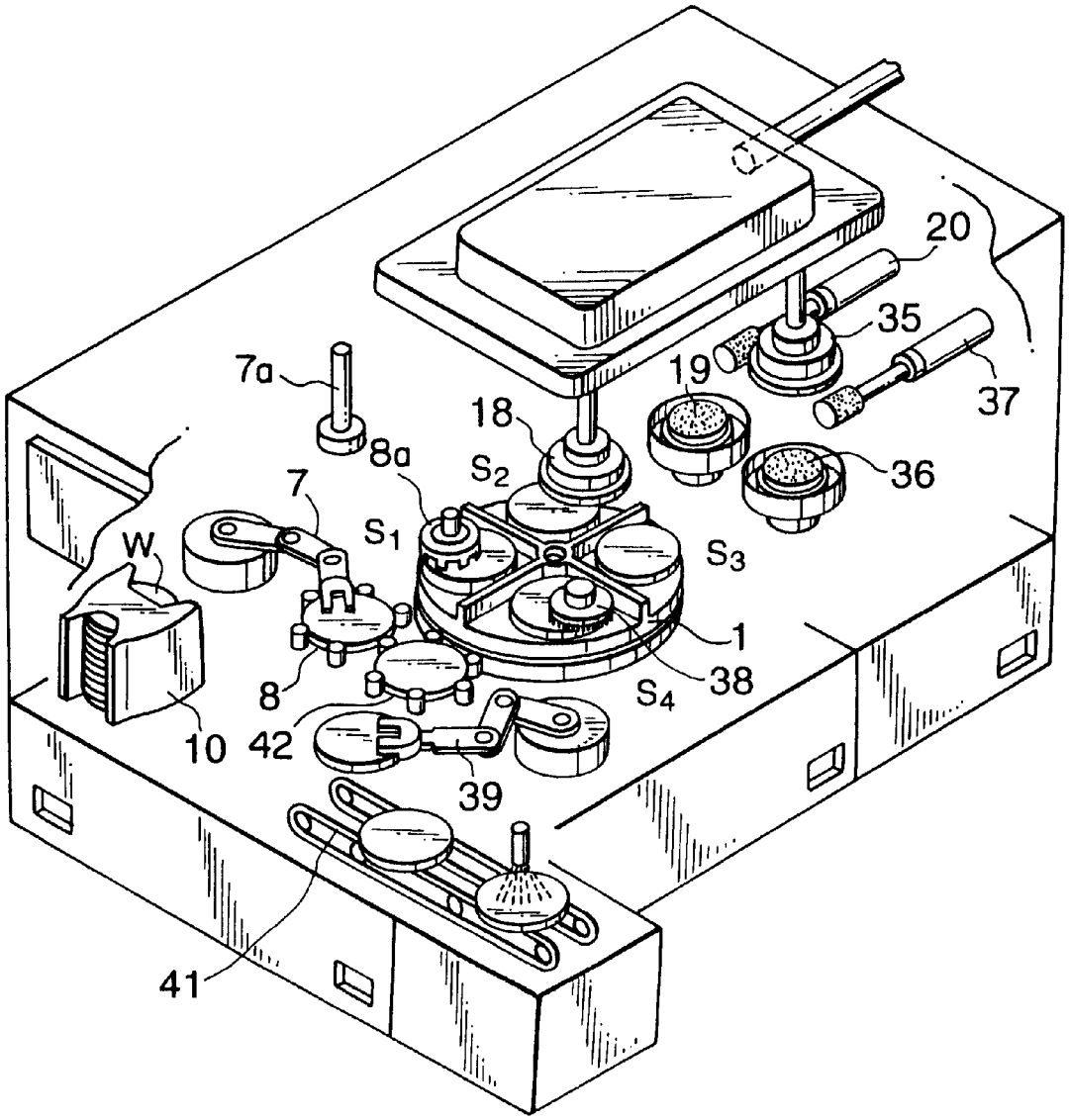
FIG. 4 is a perspective view of the polishing machine shown in FIG. 3.

Referring to FIGS. 3 and 4, there is shown an automatic polishing machine embodying the concept of the present invention. This machine has an index table 1 for holding wafers. A loading station $S_1$, a primary polishing station $S_2$ for performing a rough polishing removal, a second polishing station $S_3$ for providing the final polishing step, and an unloading station $S_4$ are established on the index table 1. These stations are circumferentially spaced from each other on the table. A plurality of wafer holders 2 for holding wafers are arranged around the center of the surface of the index table 1. These wafer holders are rotated into the stations $S_1$–$S_4$ in turn. These stations $S_1$–$S_4$ are assigned to stop positions, respectively, of the index table 1.

At the loading station $S_1$, wafers are conveyed onto the index table 1. At the unloading station $S_4$, the wafers are transported out of the index table 1. In this embodiment, the primary polishing station $S_2$ provides a region where the surface of each wafer conveyed onto the index table 1 is flattened. At the second polishing station $S_3$, the surfaces of the flattened wafers undergo a final polishing step.

At the loading station $S_1$, the wafers W stored in a wafer cassette 10 are picked and transported onto a pin clamp 11 one by one by a robot arm 7. The rear surface of the wafer is cleaned by a wafer rear surface-cleaning means 8. Each cleaned wafer W is transported onto the holder 2 at the loading station $S_1$, using a wafer chuck 7*a*. The wafer is attracted and held to a vacuum chuck 4. As the index table 1 rotates through 90°, the wafer W on the holder 2 is conveyed into the primary polishing station $S_2$. After cleaning the next wafer with the wafer rear surface-cleaning means 8, the wafer W can be conveyed onto the holder 2 at the loading station $S_1$ by the robot arm 7. The holder 2 is cleaned by a wafer chuck-cleaning number 8*a*, which may recede from a solid line circle to a dot-dash line circle.

At the primary polishing station $S_2$, the wafer W is flattened by a polishing head 18 and sent to the second polishing station $S_3$, where the wafer is finally polished by a polishing head 35. Then, the wafer is shifted to the unloading station $S_4$, where it is cleaned with a wafer surface-cleaning means 38. The wafer surface-cleaning means 38 may recede form a solid line circle to a dot-dash line circle.

After the cleaning, each wafer W is transported from the holder 2 onto a pin clamp 40 by a wafer chuck 39*a*. The rear surface of the wafer is cleaned by a wafer rear surface-cleaning means 42. Alternatively, after the cleaning, the wafer W may be moved onto the pin clamp 40 by a wafer chuck 39*a*, and the rear-surface of the wafer may be cleaned by the wafer rear surface-cleaning means 42. Then, the wafer may be transported onto a conveyor 41 by the robot arm 39. Subsequently, the wafer is carried onto the conveyer 41 from the pin clamp 40 by the robot arm 39 and sent out for the next processing step.

Figure 5:
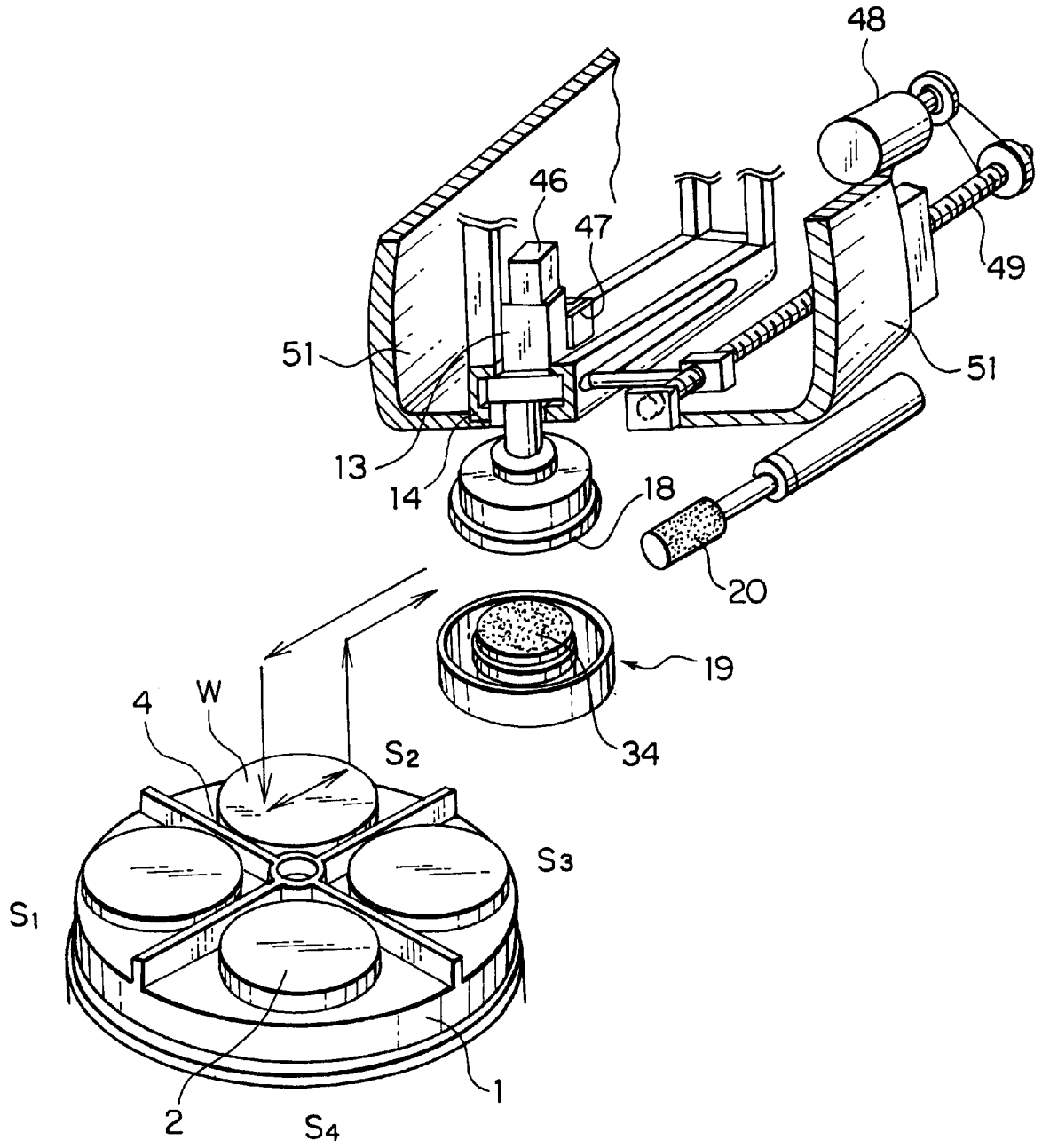
FIG. 5 is a partially cutaway perspective view of the primary polishing station in the polishing machine in accordance with the invention.

Meanwhile, the index table 1 rotates through a given angle and shifts the holder 2 free of the wafer W to the loading station $S_1$, and makes preparations for entry of the next wafer. In the present invention, the primary polishing station $S_1$, has the polishing head 18, the pad conditioning means 19, and the pad cleaning means 20, as shown in FIGS. 4 and 5.

Figure 6:
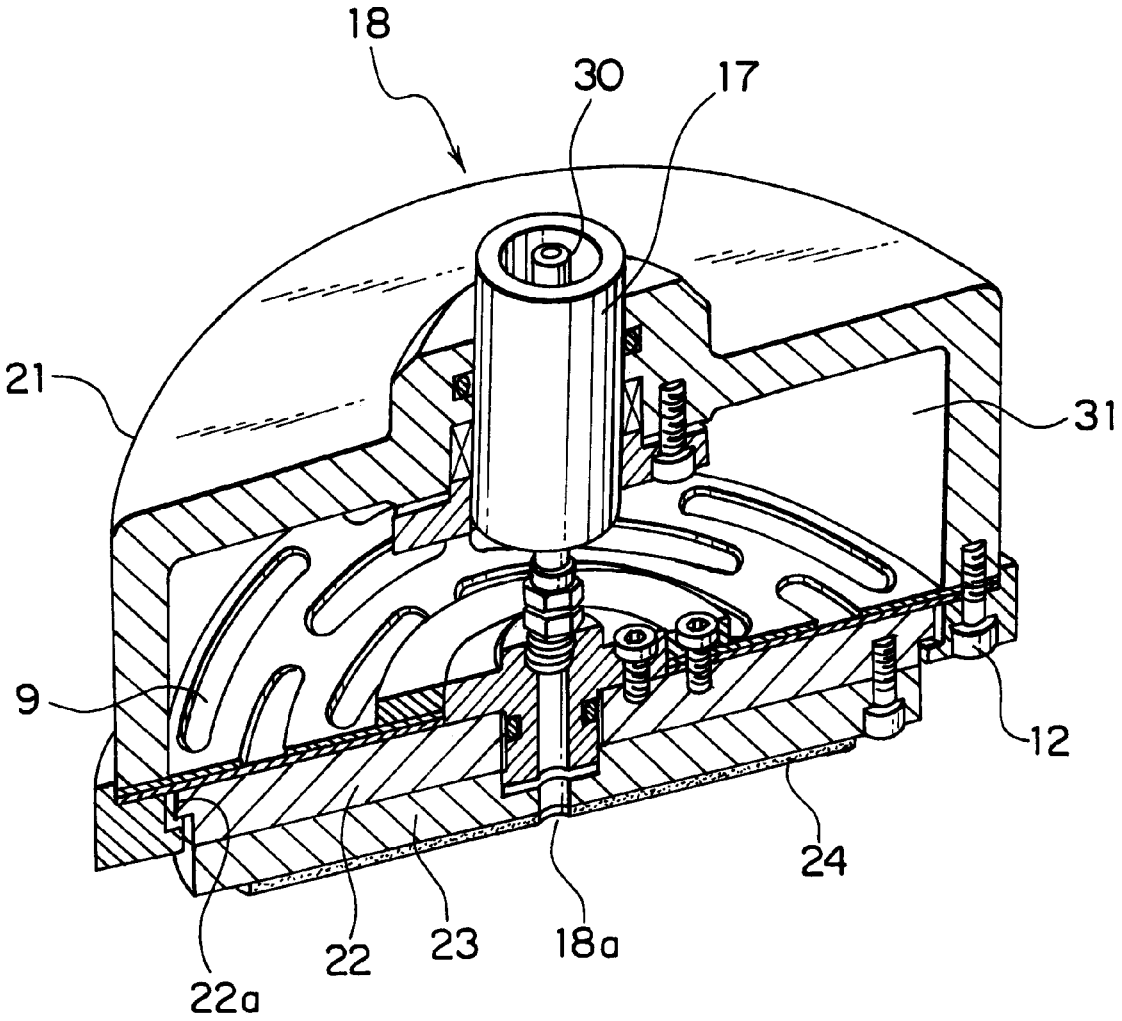
FIG. 6 is a perspective view of a polishing head in the polishing machine in accordance with the invention, showing the internal structure of the head.
Figure 7:
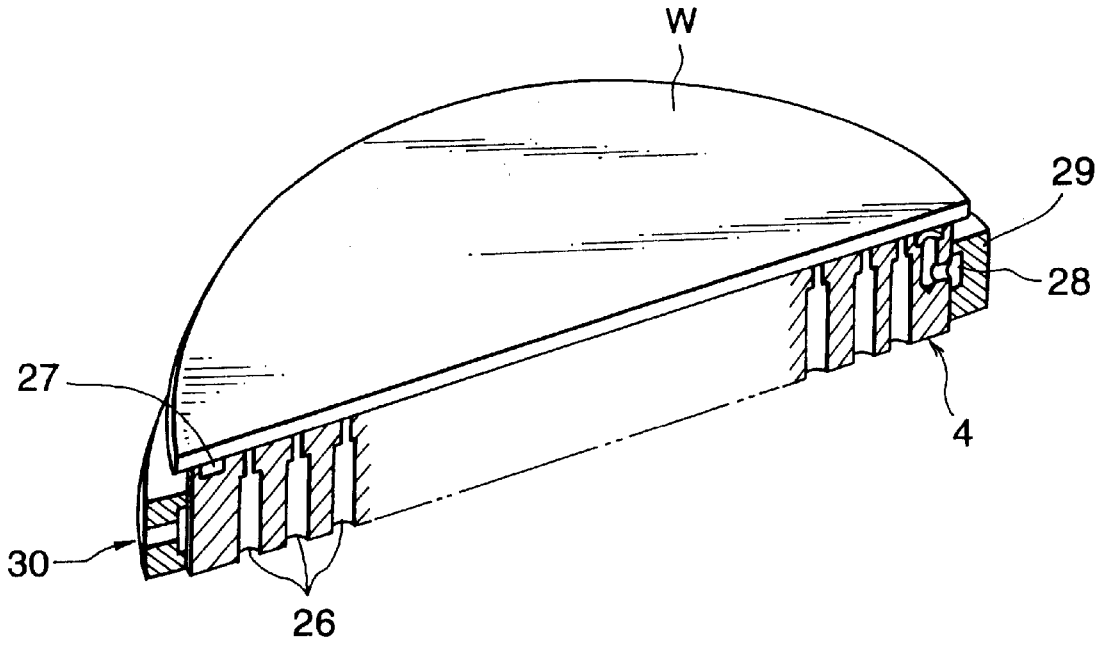
FIG. 7 is a perspective view of a vacuum chuck in the polishing machine in accordance with the invention.

As shown in FIG. 6, the polishing head 18 consists of an assembly of a pressure application cylinder 21, a base plate 22, and a polishing plate 23 having a polishing surface to which polishing cloth 24 is attached. The polishing cloth 24 is a hard circular polishing pad. The head 18 depends from a spindle 17 that holds the pressure application cylinder 21. As shown in FIG. 5, the polishing head 18 advances from its retracted position into a position located above the vacuum chuck 4 at the primary polishing station $S_2$. Then, as shown in FIG. 7, the head lowers onto the wafer W attracted to the vacuum chuck 4, pressing the polishing cloth 24 against the surface of the wafer W. The head roughly polishes the surface to flatten it. This rough polishing is done by rotating the holder 2 holding the wafer W to rotate the polishing head 18 in one direction and supplying the slurry from slurry supply holes 18*a* formed at the center position of rotation and the peripheral position onto the polishing cloth 24, the slurry being sent by a slurry supply pump. The slurry is dispersed uniformly between the polishing cloth 24 and the wafer W. The holder 2 can be rotated at a high speed. When the slurry is supplied from the center of rotation, it is very important to send the slurry under pressure in supplying the slurry onto the whole surface of the polishing cloth uniformly. The pressure is 0.01 to 0.1 kg/cm$^2$.

Figure 9A:
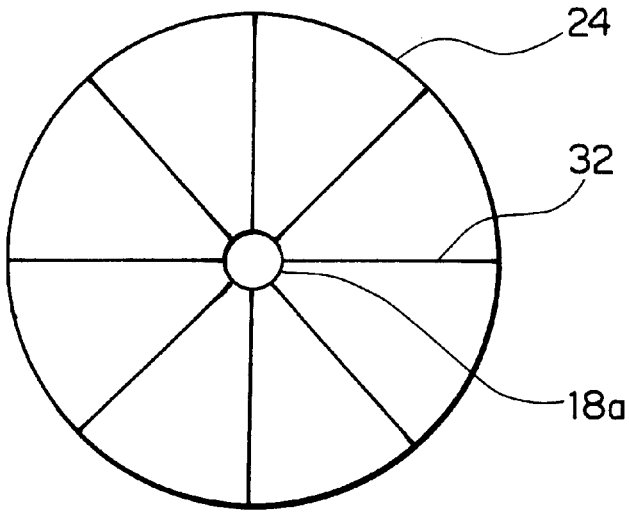
FIG. 9A is a plan view of a polishing cloth (pad) for use in the polishing machine in accordance with the invention, and in which the cloth is provided with slurry guide grooves.
Figure 9B:
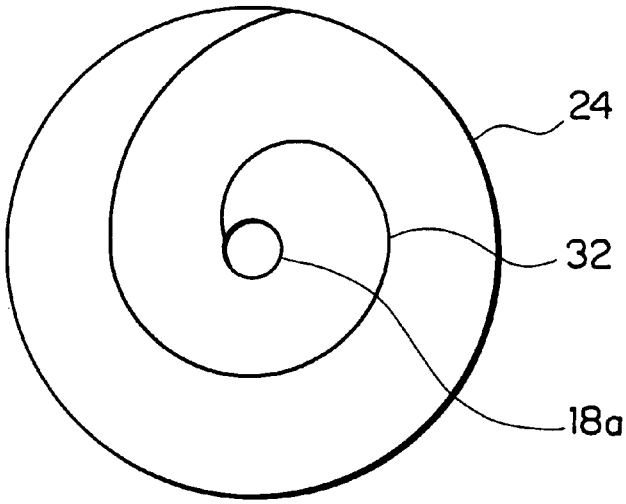
FIG. 9B is a view similar to FIG. 9A, but in which the polishing cloth is provided with a spiral slurry guide groove.
Figure 9C:
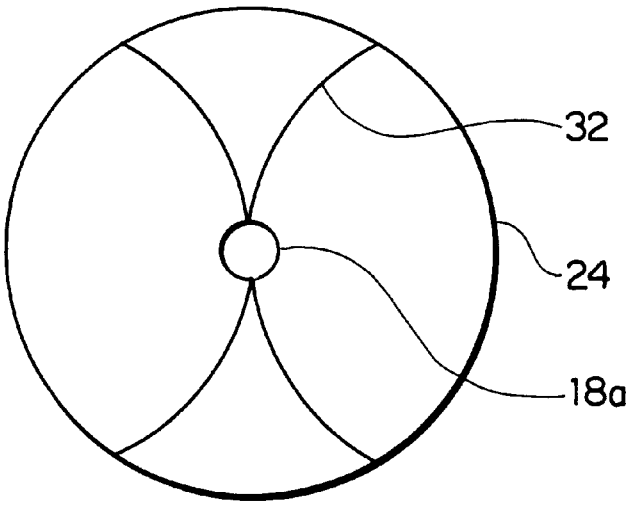
FIG. 9C is a view similar to FIG. 9A, but in which the polishing cloth is provided with curved slurry guide grooves.

Referring to FIGS. 9A through 9C, the surface of the polishing cloth 24 is provided with at least one diffusive groove 32 in communication with the slurry supply hole 18*a*. The slurry sent from the slurry supply hole 18*a* is guided toward the outer periphery of the polishing cloth 24 by the diffusive grooves 32, whereby the slurry is dispersed uniformly over the polishing surface. In FIG. 9A, the diffusive grooves 32 extend radially from the slurry supply hole 18*a*. In FIG. 9B, one diffusive groove 32 extends spirally from the slurry supply hole 18*a*. In FIG. 9C, the diffusive grooves 32 are curved lines extending from the center to the outer periphery. In this way, the diffusive grooves can be any arbitrary straight lines or curved lines running from the center to the outer periphery.

The optimum material of the polishing cloth is a film of hard high polymer such as foamed polyurethane, such as IC-1000 manufactured by Rodale Nitta Co., Ltd., Japan.

A laminated polishing cloth such as IC-1000 on polyester fiber polishing cloth, Suba 400, manufactured also by Rodale Nitta Co. Ltd., Japan, is applicable. No limitations are imposed on the diameter of the polishing cloth 24. Where the diameter of the polishing cloth is about half of the diameter of the wafer to be polished, the diameter of the cloth is approximately 90 to 110 mm provided the wafer is 8 inches (200 mm) in diameter. The appropriate width of the diffusive grooves for efficiently dispersing the slurry is about 0.5 to 2 mm. The shape of the polishing cloth 24 is not limited to circular form.

Figure 10A:
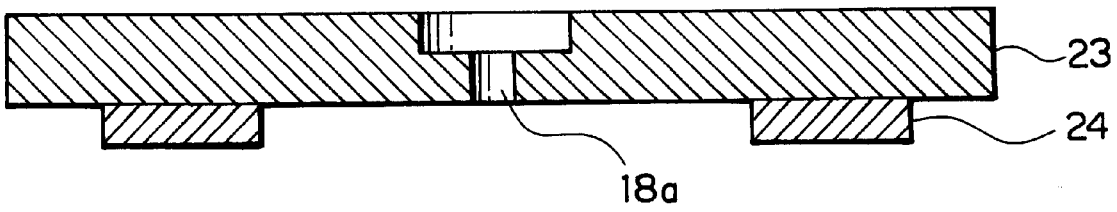
FIG. 10A is a cross-sectional view of another polishing cloth for use in the polishing machine in accordance with the invention, illustrating the manner in which the cloth is placed.
Figure 10B:
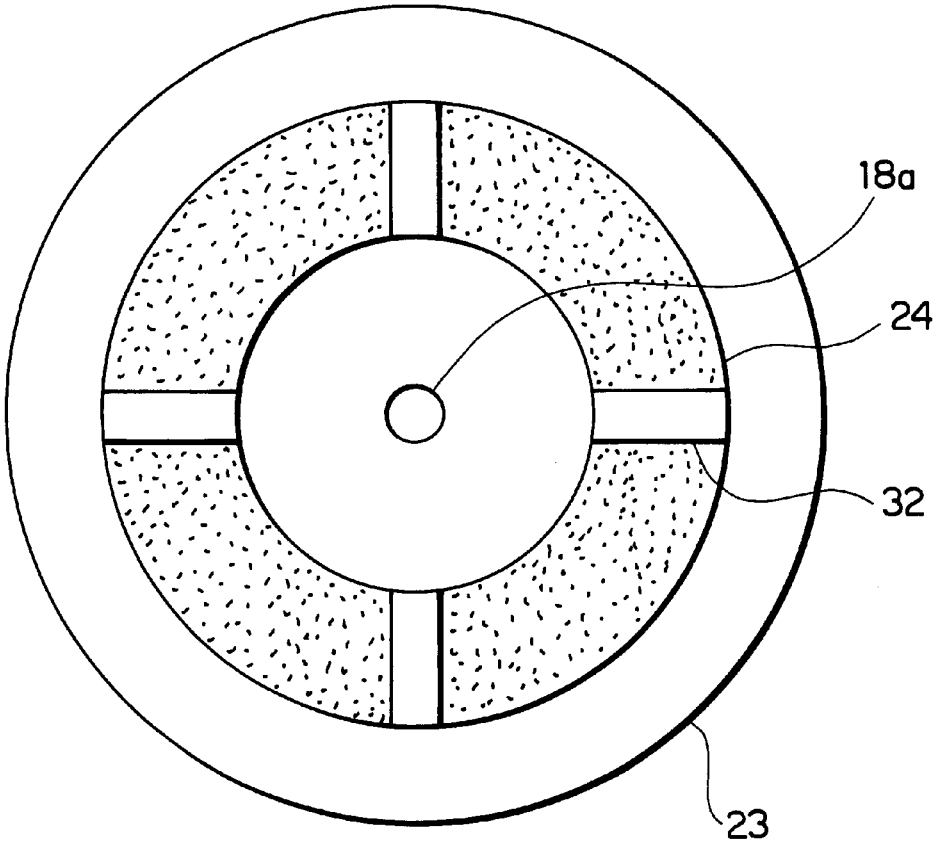
FIG. 10B is a bottom view of the polishing cloth shown in FIG. 10A.

As shown in FIGS. 10A and 10B, the polishing cloth 24 may assume an annular shape formed by cutting out an outer portion of a disk. The cloth 24 is attached to the polishing plate 23. This polishing cloth 24 is also provided with diffusive grooves 32 for dispersing polish slurry. The diffusive grooves 32 may not extend to the outer periphery. That is, the grooves 32 may be formed within the polishing cloth. In this case, the ends of the diffusive grooves 32 are inside the polishing cloth and so movement of the slurry out of the polishing pad is suppressed. That is, the slurry can stay in the cloth for a longer time. The outside diameter of the polishing cloth is from a value comparable to the diameter of the wafer to a value about half of the diameter of the wafer. The thickness of the grooves 32 is approximately 0.5 to 5 mm. For example, in the case of an 8 inch (200 mm) wafer, the outside diameter of the polishing cloth 24 is 150 mm. The thickness of the cloth is 3 mm. The width of the diffusive grooves 32 is 2 mm. In this example, four diffusive grooves 32 are regularly circumferentially spaced from each other. No limitations are placed on the number of the grooves or on the arrangement. The polishing cloth may be fabricated by placing polishing cloth of foamed polyurethane on polyester fiber polishing cloth (such as SUB 400 manufactured by Rodale Nitta Co., Ltd.). Where the polishing cloth is circular or annular, the slurry contacts the surface of the polishing plate 23. Therefore, the polishing plate 23 must have sufficient resistance to chemicals. For this purpose, the polishing plate 23 is a sintered alumina plate or a stainless steel plate to which a sintered alumina plate is bonded.

As shown in FIG. 7, the wafer W is clamped to attracting holes 26 in the vacuum chuck 4. This chuck 4 has a water seal chamber 27 that is annular in shape and provided with an opening on its topside. The seal chamber 27 is formed outside the opening regions of the attracting holes 26. The seal chamber 27 is in communication with a water channel 28 connected to a side surface of the vacuum chuck 4. The water channel 28 is connected with a water supply hole 30 extending to the inner surface of a fixed seal ring 29 that is on the side of the index table. Wash water is forced into the water supply hole 30 and made to overflow from the water seal chamber 27. This prevents the slurry from passing under the wafer W; otherwise, the wafer W would adhere to the wafer-holding surface during polish. Furthermore, the slurry is prevented from entering the attracting holes 26 in the vacuum chuck 4.

Figure 8:
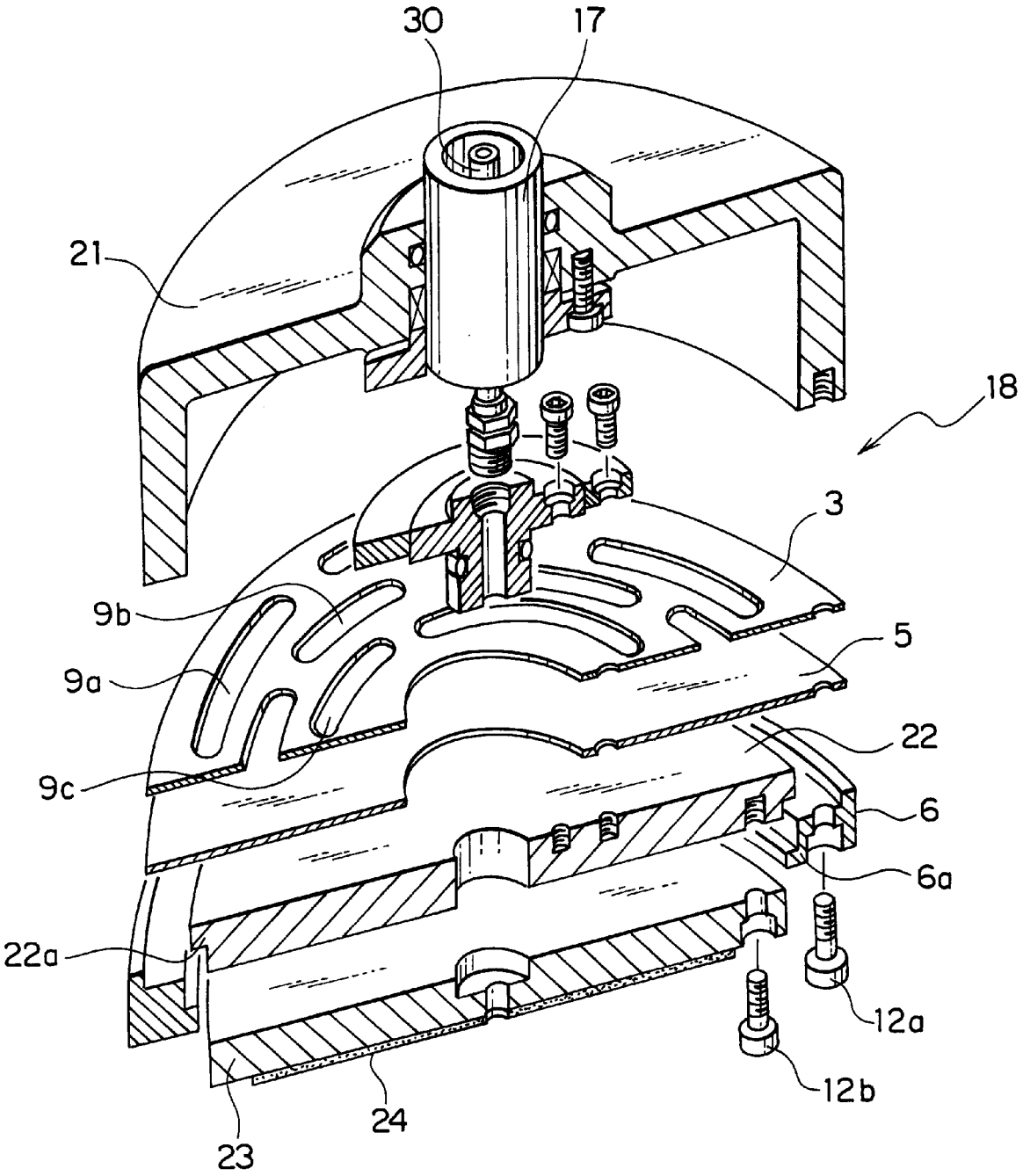
FIG. 8 is an exploded perspective view of a polishing head in a polishing machine in accordance with the invention, showing the internal structure of the head.

The polishing head 18 is an assembly of the pressure application cylinder 21, the base plate 22, and the polishing plate 23. As shown in FIG. 8, a drive plate 3 and a diaphragm 5 are mounted between the pressure application cylinder 21 and the base plate 22. The fringes of the laminate of the drive plate 3 and the diaphragm 5 are supported by a flange 6, which is clamped to the lower end of the cylinder 21 by bolts 12*a*. The flange 6 is annular and has an inwardly extending overhang 6*a*. The base plate 22 is held on the overhang 6*a*. The polishing plate 23 is mounted to the base plate 22 by bolts 12*b*.

The diaphragm 5 maintains the hermeticity between the pressure application cylinder 21 and the base plate 22. The drive plate 3 can follow the movement of the base plate 22 in three dimensions and gives support strength to the base plate 22.

The optimum materials of the diaphragm 5 are synthetic rubber, natural rubber, fluororubber, and Bakelite resin. Note that no limitations are imposed on the material of the diaphragm as long as it can maintain the hermeticity between the pressure application cylinder 21 and the base plate 22 and move quite small distances in three dimensions.

In this embodiment, the drive plate 3 is a metal plate provided with three sets of arc-shaped holes 9*a*, 9*b*, 9*c*, etc. to impart flexibility to the plate. The drive plate 3 and the diaphragm 5 are inserted between the pressure application cylinder 21 and the base plate 22 to permit the base plate 22 to swing relative to the pressure application cylinder 21 in three dimensions.

It is necessary that the drive plate 3 is capable of transmitting rotation of the spindle 17 to the base plate 22 and of moving quite small distances in three dimensions, especially in the vertical direction. Accordingly, the arc-shaped holes 9 are formed in the metal plate having a thickness of about 0.5 to 3 mm. The three sets of arc-shaped holes 9*a*, 9*b*, and 9*c* are formed along coaxial arcs having different radii. The holes have widths of about 3 to 30 mm. The outermost holes 9*a* and the innermost holes 9*c* are on the same radial lines within the drive plate 3. However, the intermediate holes 9*b* are on different radial lines. In this way, the drive plate 3 can move quite small distances in three dimensions, especially in the vertical direction, while maintaining the rigidity.

Figure 1:
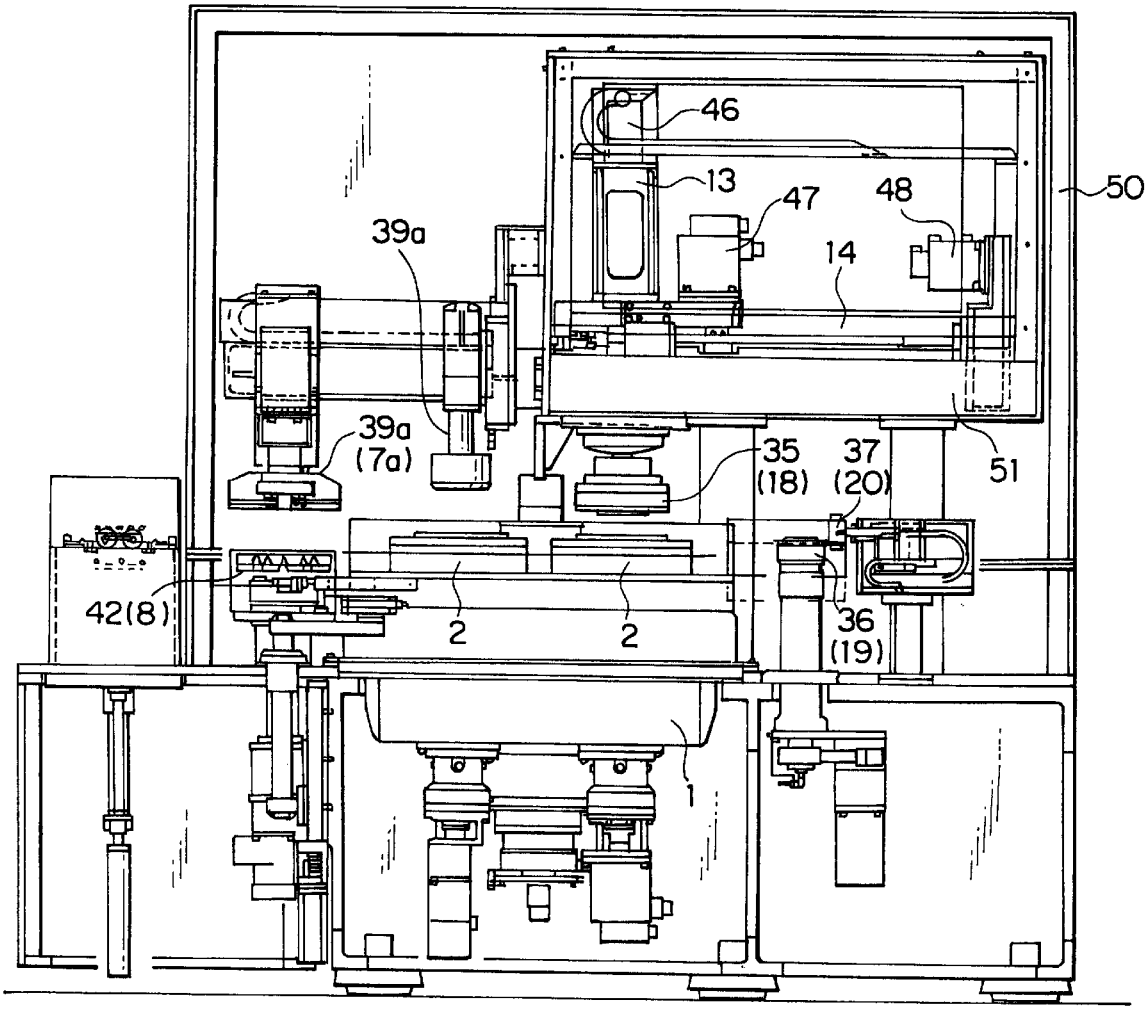
FIG. 1 is a side elevation of a polishing machine in accordance with the present invention.
Figure 2:
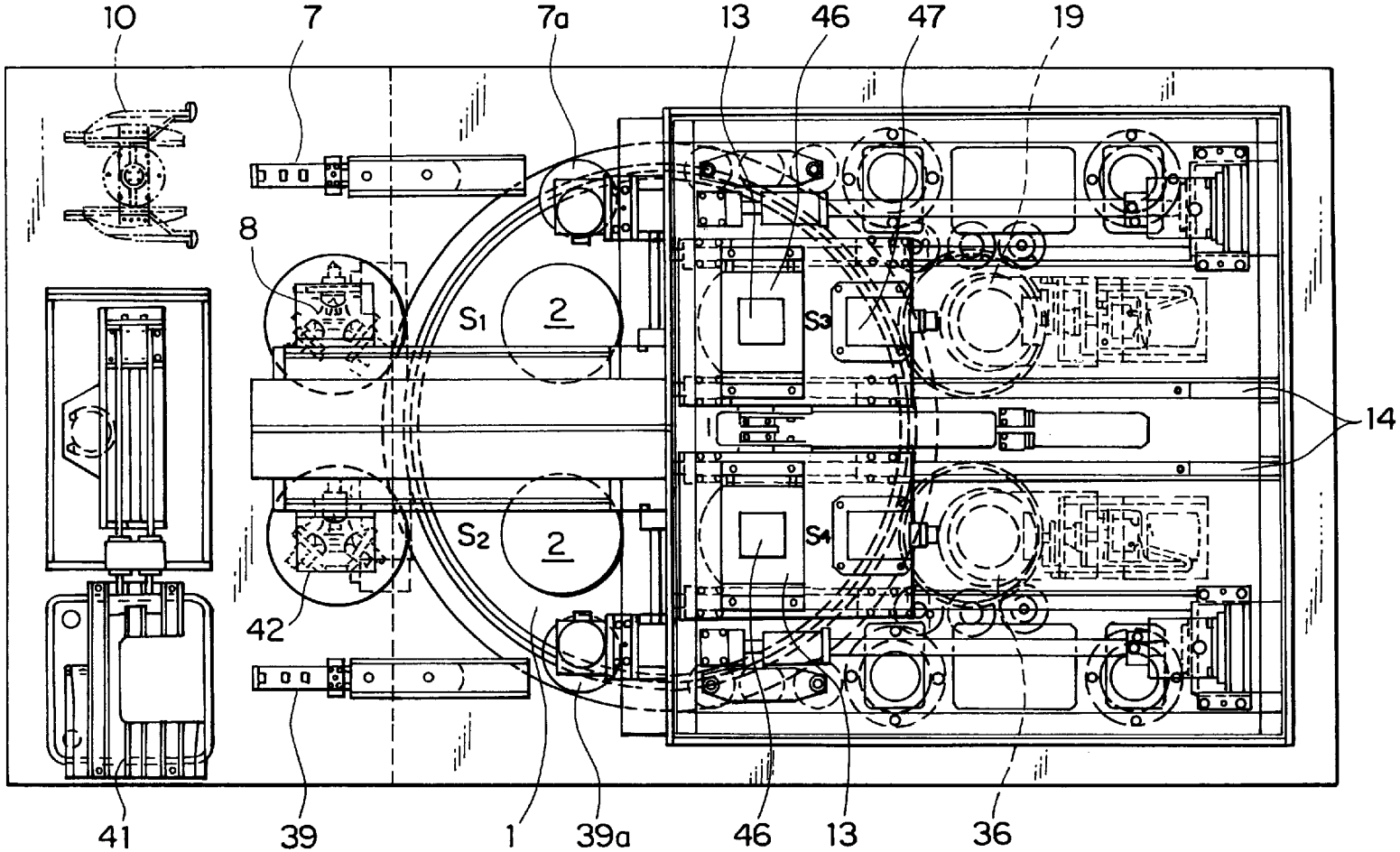
FIG. 2 is a plan view of the polishing machine shown in FIG. 1.

The swinging movement of the polishing head 18 allows fine movements in three dimensions. This is quite important for the polishing machine in accordance with the present invention. Specifically, the polishing head 18 is supported by the carrier 13, as shown in FIG. 5. The carrier 13 depends from a frame 50, as shown in FIG. 1. The carrier 13 reciprocates between the holder 2 at the primary polishing station $S_2$ of the index table 1 and its retracted position remote from the table 1 while guided by a rail 14 mounted above the index table 1. If the polishing head 18 is made of a completely rigid body, it is necessary that the wafer surface and the rail 14 be completely parallel to each other.

If this parallel relation is not satisfied, when the polishing head 18 is fed along the rail 14, the polishing pressure varies, making nonuniform the amount of the polishing across the wafer surface. In the present invention, three-dimensional structural play is given to the polishing head 18 to compensate for variations in the polishing pressure due to insufficient mechanical accuracy of the rail 14 or surface irregularities of the wafer. The fine movement of the polishing head 18 can be controlled by adjusting the pressure inside the pressure application cylinder 21. Since the rail 14 depends from the frame 50, effective use is made of the space above the index table 1. This saves the space occupied. The frame 50 is mounted to the housing of the polishing machine and located over the housing.

Figure 11:
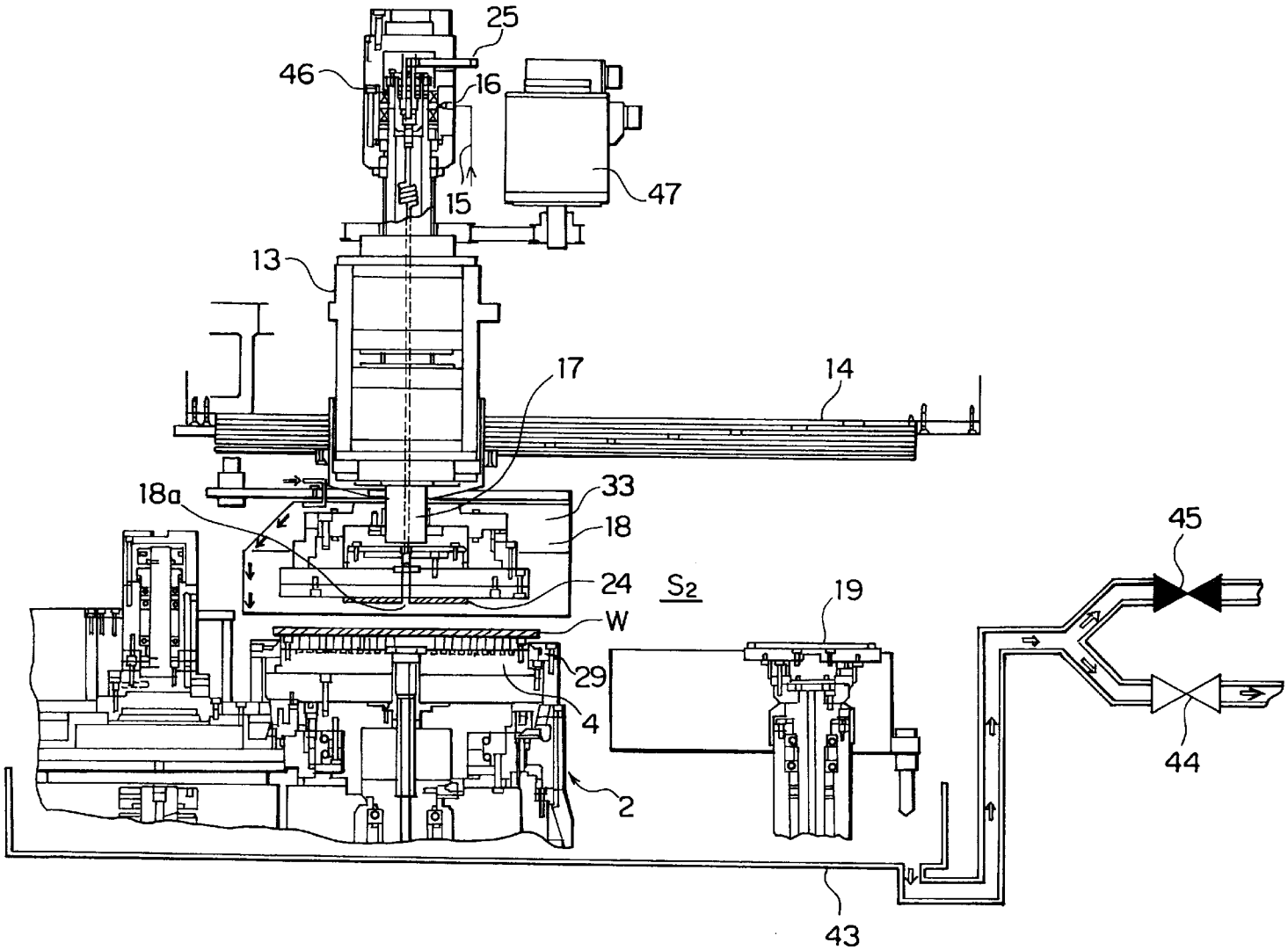
FIG. 11 is a front elevation of a polishing head in the polishing machine in accordance with the invention, and in which the head starts to polish a wafer.

As shown in FIG. 11, an external air supply tube 15 supplies high-pressure air into the spindle 17 through a nozzle 16. Thus, high-pressure air is supplied into a pressurizing chamber 31 within the pressure application cylinder 21. Fine movements in three dimensions can be adjusted by adjusting the pressure inside the cylinder 21. The aforementioned slurry supply hole 18*a* is in communication with the slurry supply tube 30 inserted in the spindle 17 as shown in FIG. 6.

Figure 12:
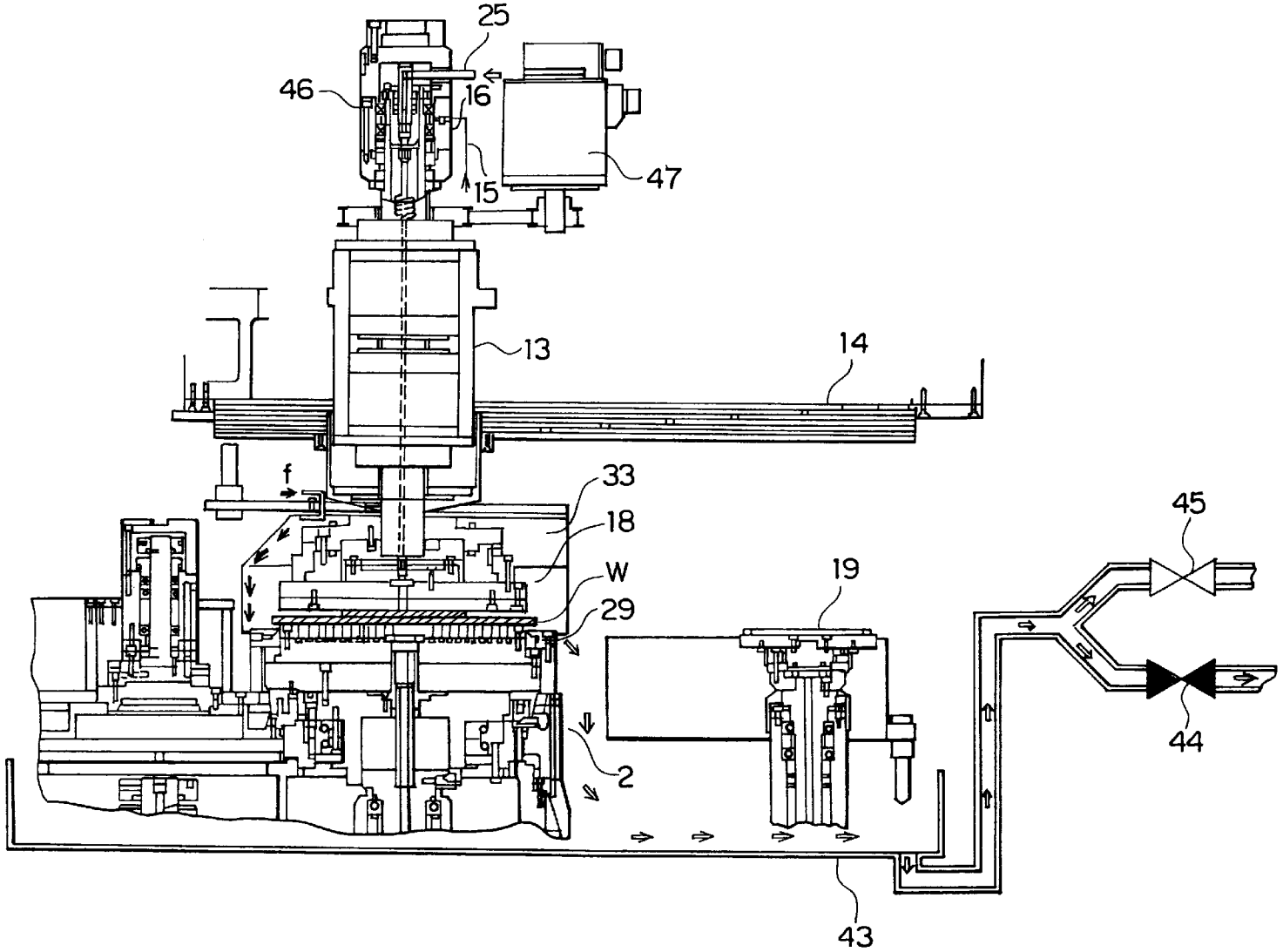
FIG. 12 is a front elevation of the polishing head shown in FIG. 11, and in which the head is polishing the wafer.

The polishing head 18 is detachably mounted to the spindle 17 and placed in position on the carrier 13. This carrier 13 comprises an air cylinder 46 forming a vertical drive mechanism and an electric motor 47 forming a rotary drive mechanism, as shown in FIGS. 1 and 5. The air cylinder 46 moves the polishing head 18 up and down. The motor 47 rotates the polishing head. Another motor 48 is mounted on the side of the rail 14 to feed the carrier 13. As the motor 48 turns, a feed screw 49 is rotated. The carrier 13 is moved from its retracted position along the rail 14 by the rotation of the feed screw 49. Then, the carrier 13 is sent over the holder 2 at the station $S_2$ shown in FIG. 11. Subsequently, the movement of the carrier 13 is controlled by the vertical drive mechanism 46 and lowered above the holder 2, as shown in FIG. 12. Then, the polishing head 18 is driven straight along the rail 14 and, at the same time, is rotated by the rotary drive mechanism 47. Consequently, the polishing head 18 polishes the wafer W rotating on the holder 2.

The feed mechanism 48 consisting of the motor as described above reciprocates the polishing head 18 set on the carrier 13 along the rail. During polish of the wafer W, the feed speed is controlled according to the polishing position. For example, when the center of the wafer is being polished at a lower peripheral speed, the feed speed is made lower. When peripheries of the wafer are being polished, the feed speed is increased. In this manner, the whole wafer can be polished uniformly. The pressure applied to the vertical drive mechanism 46 is 0.05 to 1 kg/cm$^2$. The rotating speed of the head 18 is approximately 30 to 1000 rpm. The rotating speed of the wafer is about 10 to 300 rpm. The direction of rotation of the polishing head 18 may be identical or opposite to the direction of rotation of the wafer. For instance, the polishing head 18 rotating in a counterclockwise direction at 500 rpm is reciprocated at 0.5 cm/second on the wafer rotating in a clockwise direction at 30 rpm.

The scanning speed of the polishing head 18 is not required to be kept constant. In practice, polishing conditions are established by entering a rotating speed of the wafer, scanning coordinates within the wafer, a scanning speed, a range of reciprocating movement, a rotating speed, and a polishing pressure of the polishing head into a control computer incorporated in the present polishing machine. The carrier 13 including the rail 14, the vertical drive mechanism 46, and the rotary drive mechanism 47, the feed screw 49, etc. are covered by a cover 51 mounted to the frame 50. The pressure inside the cover 51 is made negative by performing local evacuation. Dust and powder might be created by wear of the rail 14 and the feed screw 49. Oily components might be splashed from the vertical drive mechanism 46 and from the rotary drive mechanism 47. The cover 51 prevents such dust, powder, and oily components from dropping on the index table 1.

As the spindle 17 rotates, the torque is transmitted to the base plate 22 via the laminate of the drive plate 3 and the diaphragm 5 within the pressure application cylinder 21. During polishing the wafer, the slurry fed from the pump is forced into the supply tube 30 from the slurry supply tube 25. The slurry is supplied onto the wafer from the supply hole 18*a*. Simultaneously with the end of polish, the valve is switched to supply pure water into the slurry supply tube 25, replacing the slurry inside the supply tube 30 with pure water. Also, the slurry on the wafer is replaced by pure water during decreasing polishing pressure. This stops the progress of the polish. The supply tube 30 is a metal tube whose inner wall is coated with polyfluoroethylene. Where a slurry (such as QCTT1010 produced by Rodale Nitta Co., Ltd., Japan) capable of etching a metal, for example, a thin copper film mounted on the wafer is used, it is quite important to replace the slurry in the supply tube 30 with pure water as soon as the polishing operation ends, because this will prolong the service life of the slurry supply tube 30.

As shown in FIG. 12, the polishing head 18 is covered by a hood 33 mounted to the carrier 13. During and after the polishing of the wafer, wash (rinse) water f is continued to flow along the inner surface of the hood 33. This prevents splashing slurry from solidifying; otherwise, solidified abrasive would fall, thus damaging the wafer W. During polishing, pure water is also supplied from a sealing portion mounted at the periphery of the holder 2. As a result, the slurry is prevented from going to the rear surface of the substrate all the way.

Figure 13:
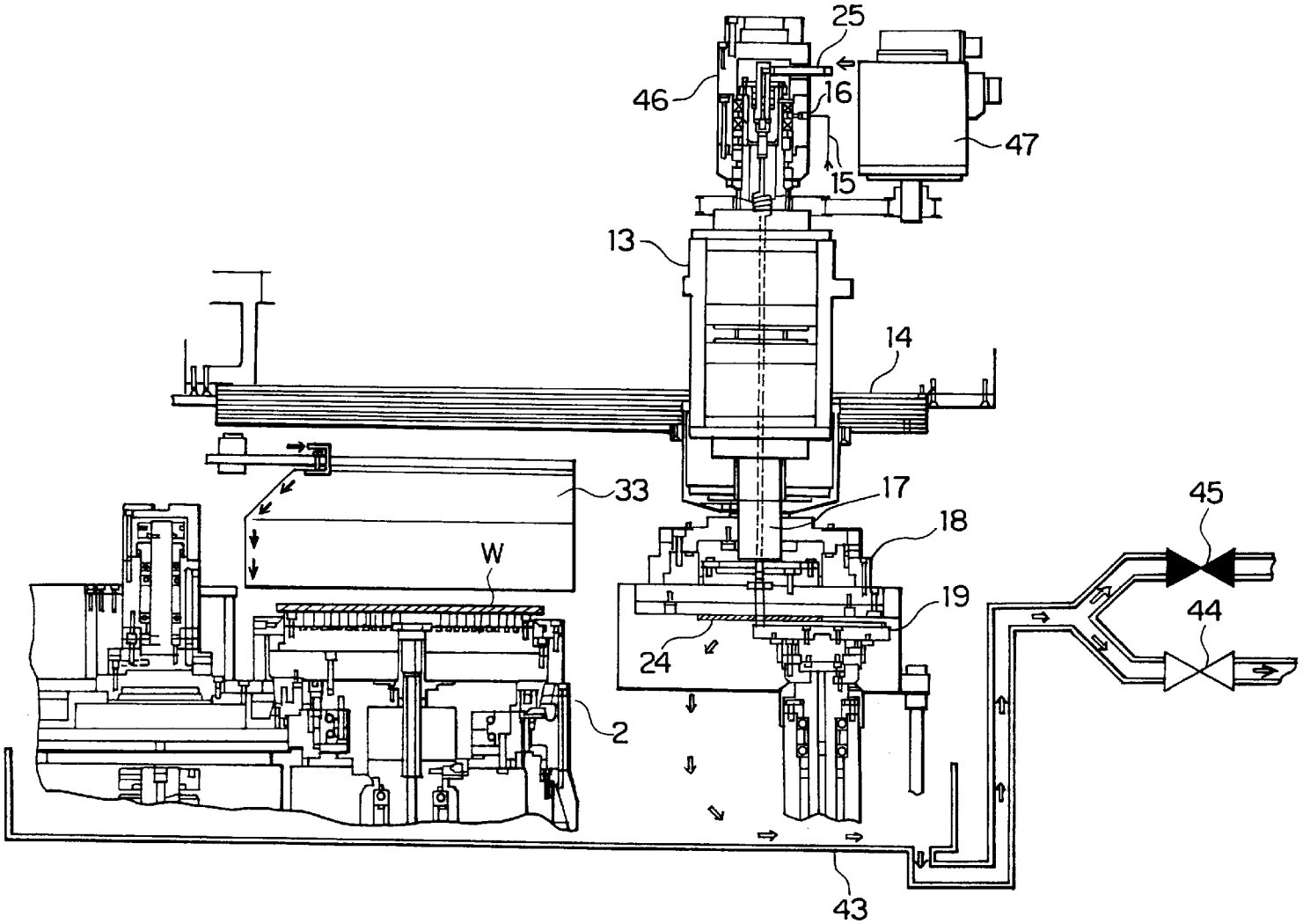
FIG. 13 is a front elevation similar to FIG. 12, but in which the polishing cloth is being conditioned.

Referring to FIG. 5, as the wafer W is polished, the polishing cloth 24 of the polishing head 18 becomes clogged (i.e., the mesh becomes nonuniform). This is corrected by returning the polishing head 18 into its retracted position and conditioning the cloth by the pad conditioning means 19. This pad conditioning means 19 has a pad conditioning disk 34 that rotates. As shown in FIG. 13, this disk 34 is pressed against the polishing cloth 24 of the polishing head 18 while rotating the disk, thus conditioning the cloth. At this time, pure water is supplied into the slurry supply tube 25. The surface of the polishing cloth 24 is washed with pure water discharged from the supply hole 18*a*.

Normally, the pad conditioning disk 34 is made of a plate on which diamond particles of 10 to 500 $\mu$m are electrodeposited. During conditioning of the polishing cloth, the diamond particles might come off. In the present polishing machine, the cloth 24 faces downward. Therefore, released diamond particles do not easily adhere to the polishing cloth.

When the polishing cloth 24 is conditioned, further high-pressure air is admitted into the pressurization chamber 31 of the pressure application cylinder 21 in FIG. 6 to press protruding fringes 22*a* of the base plate 22 against the protruding fringes 6*a* of the flange 6 via the diaphragm 5 with a given pressure higher than the polishing pressure. The base plate 22 to which the polishing cloth 24 is attached is clamped against the pressure application cylinder 21, fastening the cloth 24. After the cloth 24 is conditioned, the pad cleaning means 20 consisting of a brush is reciprocated while rotated. This removes abrasive particles and powder adhering to the surface of the polishing cloth 24. In this way, preparations are made for rough polishing of the next wafer. Then, the index table 1 is rotated through a given angle of 90° to transport the wafer W flattened by the rough polishing into the second polishing station $S_3$.

In FIGS. 3 and 4, at the second polishing station $S_3$, final polishing is performed to reduce the roughness of the surface of the wafer that has been flattened by the primary (rough) polishing. Generally, a polishing slurry for the final polishing may be different from the slurry used in the primary polishing at the first polishing station $S_2$.

For example, where copper is buried into openings in an interlayer dielectric layer by polishing a thin copper film on the dielectric layer to remove the copper film, an acidic alumina slurry with pH of about 1 to 2 is used as the polishing slurry to etch the copper at a high etch rate during the primary polishing. In the final polishing, the interlayer dielectric film is exposed, and a weakly acidic silica slurry with pH of about 4 to 6.5 is used to suppress etching of the copper. This prevents the copper buried in the openings from dishing. The second polishing station $S_3$ is also fitted with the pad conditioning means 36 and the pad cleaning means 37 as well as the polishing head 35 in the same way as the primary polishing station $S_2$.

The wafer W transported into the second polishing station $S_3$ is finally polished by the polishing head 35. The pad conditioning means 36 and the pad cleaning means 37 condition and clean the polishing cloth of the polishing head 35, in exactly the same way as the processing performed at the primary polishing station $S_2$.

As shown in FIGS. 11–13, in this embodiment, the wash water is kept supplied during, before, and after the rough and final polishing operations. Except during the polishing of the wafer, the used rinse water is once stored in a water vessel 43, as shown in FIGS. 11 and 13. A discharge valve 44 is opened to discharge the water to the outside. During the polishing process, a recycle valve 45 is opened to recover the water into the recycling piping together with the slurry supplied to the polishing head, as shown in FIG. 12. The discharged slurry recovered into the recycling piping is diluted with pure water. Therefore, the discharged slurry is condensed with an ultrafilter and then it is reused as a slurry. At this time, $Cu^{2+}$ ions and so on in the discharged slurry are removed if necessary.

The polishing pad used on the polishing head 35 mounted at the second polishing station $S_3$ consists of a polishing cloth that is harder than the polishing cloth used on the polishing head 18 at the primary polishing station $S_2$. Generally, the final polishing step is performed for a longer time than the rough polishing step. For the final polishing, polyurethane-impregnated polyester fiber polishing cloth (such as SUBA800 manufactured by Rodale Nitta Co., Ltd.) is used. The same hard polishing cloth as used at the primary polishing station can also be used. On completion of the final polishing step, the index table 1 rotates through a given angle. This transports the wafer W into the unloading station $S_4$ at the same time as surface of the index table 1 is cleaned by cleaning liquid.

Then, the wafer W is transported to a scrubber (not shown) by the conveyor 41 by the robot arm 39, as shown in FIG. 4. During the transportation, pure water is sprayed against the surface of the wafer to prevent it from drying. The scrubber has a first processing chamber in which both front and rear surfaces of the wafer are simultaneously washed with brushes to remove slurry particles. In this example, an electrolyte is used as cleaning liquid. In a second chamber, the surface of the wafer is cleaned with pin brushes having a diameter of 10 to 20 mm. A weakly acidic liquid or electrolyte containing citric acid or a mixture of about 0.01 to 0.1% buffered HF and 1 to 20% hydrogen peroxide water is used to clean the copper-buried wafer surface.

In a third chamber, pure water is supplied onto the surface of the wafer while rotating the wafer at a high speed. A mixture of about 0.1–5% buffered HF and 1–20% hydrogen peroxide water is supplied to the rear surface of the wafer. Thus, the wafer is spin-cleaned. Pure water is supplied onto both surfaces of the wafer and cleaned. Subsequently, the wafer is spin-dried. This series of processing steps inside the scrubber completely removes the slurry particles. Also, metals such as copper are removed from the surface of the interlayer dielectric film on the surface of the wafer and from the rear surface of the wafer. Then, the wafer is transported into the LSI production line.

In the embodiment described above, after the next wafer is transported into the loading station $S_1$, the index table is rotated in given angular increments of 90°. The wafer is sent through the primary polishing station $S_2$ and the second polishing station $S_3$ to perform the rough polishing and the final polishing. The wafer is transported to the outside from the unloading station $S_4$. The wafers introduced in succession are polished roughly and finally on the same index table 1. Note that the present invention is not limited to this embodiment. The invention can be applied to wafers and other substrates held on the index table 1 for flattening.

As described in detail thus far, in the present invention, the polishing surface of a substrate on the index table 1 is always held upwardly. A polishing cloth pressed against the substrate surface can be swung finely in three dimensions. The swinging movement can be controlled. The polishing is performed while supplying the slurry onto the polishing cloth directly. Thus, the present invention yields the following advantages.

(1) The polished surface of the substrate can be observed from above and its flatness can be viewed or measured. The flatness can be modified without interrupting the polishing operation.

(2) The polishing head can be used to polish with a disk having a smaller diameter than the outside diameter of the substrate while rotating the disk at a high speed. The polishing cloth attached to the polishing head deforms viscoelastically during polish, and deformation occurs in proportion to the elapsed time within a short time (0.1 second). Accordingly, if the relative speed between the substrate and the polishing cloth is increased, the cloth becomes apparently harder and thus can enhance the accuracy at which the substrate surface is polished.

(3) With respect to the polishing uniformity across the surface of the substrate, the polishing accuracy has heretofore depended on only the viscoelastic characteristics of the polishing cloth. Therefore, parameters that can be adjusted are limited. In the present invention, it is possible to follow the unduration formed on the surface of the substrate by using a polishing head consisting of a disk having a smaller diameter than the outside diameter of the substrate. With respect to local polishing uniformity, the polishing cloth becomes apparently harder because the relative speed between the cloth and the substrate is high. Hence, flattening providing quite high uniformity can be accomplished.

(4) During polishing, the flatness, the thickness, and the temperature of the polished surface can be monitored and measured. Therefore, flatness corrective pattern can be calculated from the information about the polished surface. The polishing conditions can be established according to the circumstances of the polish.

(5) The cost of the used slurry and polishing cloth accounts for a major portion of the running cost of the polish. When slurry is supplied onto a platen to which polishing cloth is attached, most of the slurry is discharged without being used for the polishing of the substrate. In the present invention, the slurry is compressed between the polishing cloth and the substrate through a spindle. Consequently, the slurry is used at a high efficiency for the polishing of the wafer. Since the total surface of the polishing cloth touches the substrate, the whole surface of the polishing cloth is used uniformly. Hence, the cloth is not wasted.

(6) After polishing of the substrate, the polishing cloth can be rejuvenated by pressing a pad conditioning disk against the cloth. At this time, high-pressure air is admitted into the pressure application cylinder. The base plate is made stationary. The polishing cloth is prevented from vibrating during polish.

What is claimed is:

1. A polishing machine comprising:

a table for holding a substrate to be polished in position such that said substrate faces upward;

a polishing head having a bottom surface;

polishing surface means formed at least in a part of said bottom surface of said polishing head, which is capable of swinging in three dimensions for polishing said substrate held upon said table; and a polishing pad attached to said polishing surface means;

wherein said polishing head has a pressure application cylinder, and wherein said polishing pad is attached to a bottom of said pressure application cylinder via a diaphragm.

2. A polishing machine as claimed in claim 1, wherein at least one of said table and said polishing head rotates, and said polishing head moves straight over said table.

3. A polishing machine as claimed in claim 2, further comprising a rail permitting said polishing head to reciprocate between a polishing position upon said table at which said substrate is polished and a retracted position remote from said table.

4. A polishing machine as claimed in claim 3, wherein said rail depends from a frame mounted to said polishing machine and is located above said table.

5. A polishing machine as claimed in claim 3, further comprising a feed drive mechanism for reciprocating said polishing head along said rail and controls feed speed of said polishing head according to said polishing position of said substrate that is rotated while held upon said table.

6. A polishing machine as claimed in claim 5, wherein said polishing head is placed in position upon a carrier reciprocating along said rail, said carrier has a vertical drive mechanism and a rotary drive mechanism, said vertical drive mechanism drives said carrier vertically, and said rotary drive mechanism rotates said polishing head.

7. A polishing machine as claimed in claim 6, wherein if said polishing pad wears, it is pressed against a disk of a pad conditioning means to condition said pad.

8. A polishing machine as claimed in claim 7, wherein said pad conditioning means is mounted at said retracted position.

9. A polishing machine as claimed in claim 1, wherein said polishing head has a slurry supply tube having a slurry supply hole to permit a slurry supplied from the outside through a center of rotation of said polishing head to be supplied to said polishing pad.

10. A polishing machine as claimed in claim 1, wherein said pressure application cylinder is held to a carrier at a given angle, and said polishing surface means has a base plate holding said polishing pad and mounted to said pressure application cylinder via said diaphragm so as to be swingable in three dimensions.

11. A polishing machine as claimed in claim 10, wherein said pressure application cylinder is provided with a hole permitting supply of high-pressure air, and pressure of said high-pressure air admitted through said hole is acted upon said base plate to make it stationary.

12. A polishing machine as claimed in claim 11, wherein swinging movement of said polishing surface means is controlled by flow rate of said high-pressure air admitted into said pressure application cylinder.

13. A polishing machine as claimed in claim 10, wherein said pressure application cylinder and said base plate are coupled together via both said diaphragm and a drive plate, said diaphragm maintains hermeticity between said pressure application cylinder and said base plate, and said drive plate responds to displacement of said base plate and gives support strength to said base plate.

14. A polishing machine as claimed in claim 1, wherein said polishing pad comprises a polishing cloth provided with dispersive grooves which disperse supplied slurry over said polishing surface means.

15. A polishing machine as claimed in claim 14, wherein said polishing cloth is annular in shape, and said dispersive grooves extend to the inner circumference but not to the outer circumference of said polishing cloth.

16. A polishing machine comprising:

a table for holding a substrate to be polished in position such that said substrate faces upward;

a polishing head having a bottom surface;

polishing surface means formed at least in a part of said bottom surface of said polishing head, which is capable of swinging in three dimensions for polishing said substrate held upon said table; and a polishing pad attached to said polishing surface means; and wherein said polishing pad comprises a polishing cloth provided with dispersive grooves which disperse supplied slurry over said polishing surface means; and wherein said polishing cloth is annular in shape, and said dispersive grooves extend to the inner circumference but not to the outer circumference of said polishing cloth.

17. A polishing machine comprising:

a table for holding a substrate to be polished in position such that said substrate faces upward;

a polishing head having a swinging bottom section adapted to swing in three dimensions for polishing said substrate held upon said table; and a polishing pad attached to said swinging bottom section;

wherein said polishing head has a pressure application cylinder held to a canier at a given angle, and said swinging bottom section has a base plate holding said polishing pad and is mounted to said pressure application cylinder so as to be swingable in three dimensions; and wherein said pressure application cylinder and said base plate are coupled together via both a diaphragm and a drive plate, said diaphragm maintains hermeticity between said pressure application cylinder and said base plate, and said drive plate responds to displacement of said base plate and gives support strength to said base plate.

* * * * *